United States Patent [19]

Armstrong

[11] Patent Number: 4,865,302

[45] Date of Patent: Sep. 12, 1989

[54] DEVICE FOR FACILITATING ATTACHMENT OF ORNAMENTS TO BALLOON

[76] Inventor: Wes Armstrong, Rte. 2, Box 520, Linden Rd., Durham, N.C. 27705

[21] Appl. No.: 167,635

[22] Filed: Mar. 14, 1988

[51] Int. Cl.[4] ..... B25B 1/00

[52] U.S. Cl. ..... 269/239; 269/254 R; 269/288

[58] Field of Search ..... 17/70; 83/760–763; 220/6; 206/480, 485, 491, 525; 294/165, 166, 137; 269/254 R, 87, 87.1, 87.2, 87.3, 295, 290, 239, 126–129, 130–132, 287, 288

[56] References Cited

U.S. PATENT DOCUMENTS

| | | | |
|---|---|---|---|
| 850,873 | 4/1907 | Pringle | 83/762 |
| 922,115 | 5/1909 | Epperson . | |
| 1,044,438 | 11/1912 | Briggs . | |
| 1,072,450 | 9/1913 | Hamblin | 83/762 |
| 1,338,894 | 5/1920 | Younkin | 269/128 |
| 1,523,693 | 1/1925 | Korn | 220/6 |
| 1,569,841 | 1/1926 | Mann . | |
| 1,875,410 | 9/1932 | Babcock . | |
| 2,206,154 | 7/1940 | Bixler | 83/762 |
| 2,611,949 | 9/1952 | Wanamaker | 269/130 |
| 3,199,860 | 8/1965 | Moberg | 269/87.2 |
| 4,135,706 | 1/1979 | Butticci et al. . | |
| 4,253,650 | 3/1981 | Kuzio | 269/87.2 |
| 4,454,630 | 6/1984 | Shouldis | 269/239 |

FOREIGN PATENT DOCUMENTS

| | | | |
|---|---|---|---|
| 517069 | 2/1953 | Belgium | 269/239 |

*Primary Examiner*—Robert C. Watson

*Attorney, Agent, or Firm*—Darcy, Donovan & Coleman

[57] ABSTRACT

A device for facilitating the attachment of decorative objects to an outer surface of a balloon comprises a plate-like base member, a first plate-like side wall member rigidly attached to the base member and oriented substantially perpendicularly thereto, and a second plate-like side wall member opposable to the first plate-like side wall member. Hinges pivotably secure the second plate-like side wall member to the base member so that the second plate-like side wall member can pivot from an open position for loading and unloading to a closed position wherein the second plate-like side wall member is opposed and substantially parallel to the first plate-like side wall member. A plurality of rods attached at one end to the first plate-like side wall member extend substantially parallel to the base member and to each other and cooperate with the base member, the first side wall member and the second side wall member to hold the balloon in the device. The rods define a minimum distance between the first plate-like side wall member and the second plate-like side wall member and also define at least one window to enable attachment of ornaments to the outer surface of the balloon upon a disposition of the balloon in the device. An elastic member is provided for temporarily locking the second plate-like side wall member in the closed position.

20 Claims, 1 Drawing Sheet

DEVICE FOR FACILITATING ATTACHMENT OF ORNAMENTS TO BALLOON

BACKGROUND OF THE INVENTION

This invention relates to a device for facilitating the attachment or application of objects such as ornaments to an outer surface of a balloon. More particularly, this invention relates to a device for temporarily holding a balloon for purposes of facilitating the attachment of decorative objects to an outer surface of the balloon.

Helium-filled balloons, generally in a pillow or oblate spheroid shape, are frequently provided on an outer surface with ribbons, charms, stickers, and other small ornaments to enhance the attractiveness of the balloons. Balloons filled with air or other gases may also be so decorated.

Attaching the decorative objects to the outer surfaces of the balloons can be difficult inasmuch as the balloon tends to slip out of one's grasp. The difficulties are enhanced if the person attaching the decorative objects feels pain in the musculature or joints of the hands.

Many devices have been invented for holding a spherical or cylindrical objects for purposes of facilitating work performed on the object. For example, U.S. Pat. No. 1,044,438 to Briggs is discloses a meat holding device comprising a central cylindrical section hinged to further, peripheral, cylindrical sections. The central section is supported by legs on a base board, while the peripheral sections can overlap one another to enclose and hold a piece of meat. Clamping components are provided for holding the peripheral sections together around the meat.

U.S. Pat. No. 1,569,841 to Mann depicts a ball holding device basically similar to the meat holding device of U.S. Pat. No. 1,044,438.

The devices disclosed in U.S. Pat. Nos. 1,044,438 and 1,569,841 are inappropriate for holding balloons, particularly pillow-shaped balloons, inasmuch as the balloons could slip out of the holding devices or could be damaged due to excess clamping pressure. In addition, peripheral cylindrical or edge portions of the balloons, outer surfaces would not be accessible.

OBJECTS OF THE INVENTION

An object of the present invention is to provide an easily used device for facilitating the attachment of ornaments to an outer surface of a balloon.

Another, more particular, object of the present invention is to provide such a device which holds a balloon, particularly a round pillow-shaped balloon, and provides access to a peripheral cylindrical or edge portion of the surface of the balloon.

A further particular object of the present invention is to provide such a device which holds a balloon securely and yet easily enables a rotation of the balloon to provide access to the entire peripheral cylindrical or edge portion of the balloon's surface.

SUMMARY OF THE INVENTION

A device for facilitating the attachment of objects to an outer surface of a balloon comprises, in accordance with the present invention, a base member defining a base plane, a first barrier or side wall member defining a first lateral barrier plane, and a second barrier or side wall member defining a second lateral barrier plane opposable to the first lateral barrier plane. The first side wall member is rigidly attached to the base member so that the first lateral barrier plane is substantially perpendicular to the base plane. An attachment component, preferably in the form of a hinge, is provided for pivotably securing the second side wall member to the base member so that the second side wall member can pivot from an open position for loading and unloading to a closed position wherein the second lateral barrier plane is substantially opposed to the first lateral barrier plane. Holding elements cooperate with the base member, the first side wall member and the second side wall member to hold the balloon in the device, the holding elements serving to define at least one window to enable attachment of objects such as ornaments to the outer surface of the balloon upon a disposition of the balloon in the device. A locking element is provided for temporarily locking the second side wall member in the closed position.

Preferably, the holding elements are elongated and attached to one of the base member, the first side wall member and the second side wall member. More preferably, the holding elements are rods extending substantially parallel to the base plane and to each other, each of the rods being attached at one end to the first side wall member.

Pursuant to another feature of the present invention, stop elements are attached to one of the base member, the first side wall member and the second side wall member, for preventing lateral displacement of the balloon from a resting position on the base member. The stop elements advantageously take the form of a pair of rods juxtaposed to the base member and engaging the base member substantially along their entire lengths. In a specific embodiment of the invention, the rods are four in number and are disposed in a rectangular plan configuration.

The base member and the side wall members preferably take the form of solid plate-like members, while the base member has a pair of opposed edges, the first side wall member and the second side wall member being attached to the base member at opposite ones of the edges.

Pursuant to further features of the present invention, the locking element takes the form of an elastic member having one end fastened to one of the side wall members and an opposite end releasably connectable to the other of the side wall members, the elastic member having a hook and an eyelet.

A device in accordance with the present invention is an easily used and simply manufactured. The device holds a balloon, particularly a round pillow-shaped balloon, and provides easy access to a peripheral cylindrical or edge portion of the surface of the balloon.

DETAILED DESCRIPTION

Figure 1:
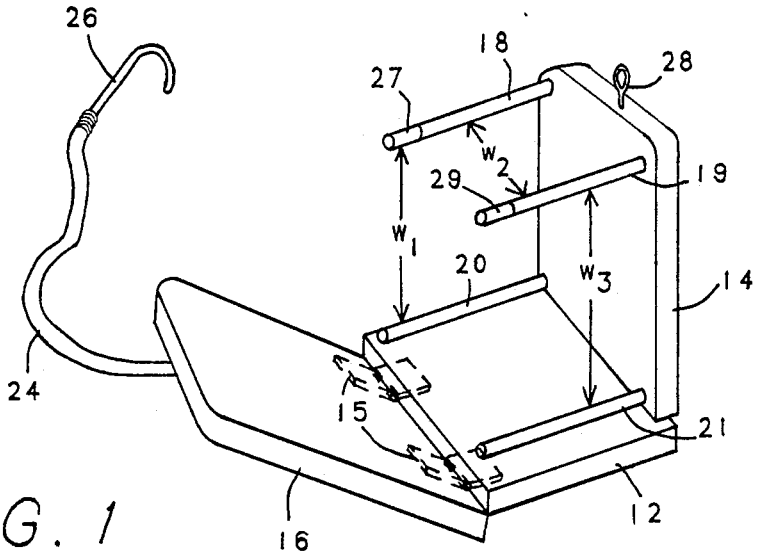
FIG. 1 is a perspective view of a device in accordance with the present invention for facilitating the attachment of ornaments to an outer surface of a balloon, showing a pivotable side wall member in an open configuration for loading.
Figure 2:
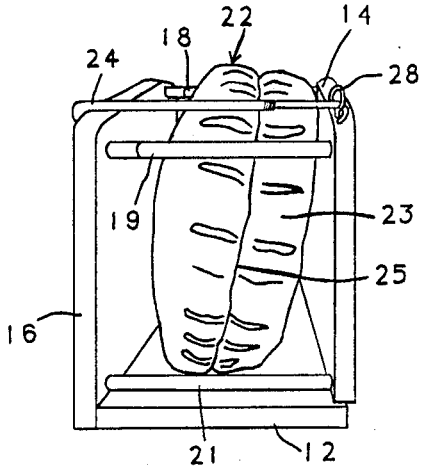
FIG. 2 is a perspective view, similar to FIG. 1, showing the device of that drawing figure holding a balloon, the pivotable side wall member being disposed in a closed orientation or configuration.

As illustrated in the drawing, a device for facilitating the attachment of ornaments to an outer surface of a balloon 22 comprises a base plate or board 12 along ne edge of which a first side wall member or end plate 14 is rigidly mounted. Another side wall member or end plate 16 is pivotably secured to an edge of base plate 12 opposite plate 14 exemplary via hinges 15 fastened to a lower surface of base plate 12 and to an outer surface of end plate 16, so that the second end plate can pivot from an open position shown in FIG. 1 to a closed position depicted in FIG. 2.

The rigidly secured end plate 14 is provided at four corners with four elongate shafts or rods 18, 19, 20 and 21 extending parallel to base plate 12. In a closed configuration of the balloon holding device (FIG. 2), the free ends of the rods are located in contact with or in juxaposition to the inner surface of pivotable end plate 16, thereby forming a cage for balloon 22. The balloon exemplary takes the form of a helium-filled oblate spheroid having a peripheral cylindrical surface portion 23 bifurcated by a substantially circular seam or edge joint 25.

An elastic member 24 having one end fastened to an outer surface of pivotable end plate 12 is provided at an opposite end with a hook 26 which cooperates with an eyelet 28 on fixed end plate 14 to lock the pivotable end plate temporarily in a closed position. Rods 18 and 19 are advantageously provided at their free ends with metal caps 27 and 29 for strengthening and maintaining the integrity of the free ends of the rods.

Rods 20 and 21 engage an upper surface of base plate 12 along the lengths of the rods and serve as stops or abutments to prevent the dislodgement of the balloon from the balloon holding device during an ornament fastening operation.

It is to be noted that the end plates define respective lateral barrier planes and that the base plate defines a base plane. It is to be further noted that rods 18–21 cooperate with base plate 12 and end plates 14 and 16 to define three rectangular windows with respective widths $w_1$, $w_2$ and $w_3$ to enable attachment of ornaments to the outer surface of balloon 22 upon a disposition of the balloon in the device Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are preferred by way of example to facilitate comprehension of the invention and should not be construed to limit the scope thereof.

What is claimed is:

1. A device for facilitating the attachment of objects to the outer surface of a balloon, said device comprising:

a base member defining a base plane;

first barrier means including a first side wall member for defining a first lateral barrier plane, said first side wall member being rigidly attached to said base member so that said first lateral barrier plane is substantially perpendicular to said base plane;

second barrier means including a second side wall member for defining a second lateral barrier plane opposable to said first lateral barrier plane;

attachment means for pivotably securing said second side wall member to said base member so that said second side wall member can pivot from an open position for loading and unloading to a closed position wherein said second lateral barrier plane is substantially opposed to said first lateral barrier plane;

holding means for cooperating with said base member, said first side wall member and said second side wall member to hold the balloon in the device and for defining at least one window to enable attachment of objects to the outer surface of the balloon upon a disposition of the balloon in the device, said holding means including a plurality of rigid elongate elements spaced from said base member and extending substantially parallel thereto in a closed configuration of the device, each of said rigid elongate elements being rigidly attached to one of said base member, said first side wall member and said second side wall member; and locking means for temporarily locking said second side wall member in said closed position.

2. The device defined in claim 1 wherein said elongate elements are rods extending substantially parallel to said base plane and to each other, each of said rods being attached at one end to said first side wall member.

3. The device defined in claim 2, further comprising stop means attached to one of said base member, said first side wall member and said second side wall member, for preventing lateral displacement of the balloon from a resting position on said base member.

4. The device defined in claim 3 wherein said stop means includes a pair of rods juxtaposed to said base member.

5. The device defined in claim 4 wherein said pair of said rods engage said base member substantially along their entire lengths.

6. The device defined in claim 4 wherein said elongate elements and the rods of said pair of rods are four in number and are disposed in a rectangular plan configuration.

7. The device defined in claim 1, further comprising stop means attached to one of said base member, said first side wall member and said second side wall member, for preventing lateral displacement of the balloon from a resting position on said base member.

8. The device defined in claim 7 wherein said stop means includes a pair of rods juxtaposed to said base member.

9. The device defined in claim 8 wherein said pair of said rods engage said base member substantially along their entire lengths.

10. The device defined in claim 1 wherein said base member is a solid plate-like member.

11. The device defined in claim 1 wherein said first side wall member is a solid plate-like member.

12. The device defined in claim 1 wherein said second side wall member is a solid plate-like member.

13. The device defined in claim 1 wherein said base plate has a pair of opposed edges, said first side wall member and said second side wall member being attached to said base member at opposite ones of said edges.

14. The device defined in claim 1 wherein said attachment means includes a hinge.

15. The device defined in claim 1 wherein said locking means includes an elastic member.

16. The device defined in claim 15 wherein said elastic member has ne end fastened to one of said first side wall member and said second side wall member and an opposite end releasably connectable to the other of said first side wall member and said second side wall member, said locking means further including a hook and an eyelet for releasably connecting said opposite end of said elastic member to said other of said first side wall member and said second side wall member.

17. A device for facilitating the attachment of objects to an outer surface of a balloon, said device comprising:

a plate-like base member;

a first plate-like side wall member rigidly attached to said base member and oriented substantially perpendicularly thereto;

a second plate-like side wall member opposable to said first plate-like side wall member;

attachment means for pivotably securing said second plate-like side wall member to said base member so that said second plate-like side wall member can pivot from an open position for loading and unloading to a closed position wherein said second plate-like side wall member is opposed and substantially parallel to said first plate-like side wall member;

holding means, including a plurality of rods rigidly at one end to said first plate-like side wall member and extending substantially parallel to said base member and to each other, for cooperating with said base member, said first side wall member and said second side wall member to hold the balloon in the device, for defining a minimum distance between said first plate-like side wall member and said second plate-like side wall member and for defining at least one window to enable attachment of objects to the outer surface of the balloon upon a disposition of the balloon in the device; and locking means for temporarily locking said second plate-like side wall member in said closed position.

18. The device defined in claim 17, further comprising stop means attached to one of said base member, said first side wall member and said second side wall member, for preventing lateral displacement of the balloon from a resting position on said base member.

19. A device for temporarily holding balloon for purposes of facilitating the attachment of objects to an outer surface of the balloon, said device comprising:

a base member defining a base plane;

first barrier means including a first side wall member for defining a first lateral barrier plane, said first side wall member being rigidly attached to said base member so that said first lateral barrier plane is substantially perpendicular to said base plane;

second barrier means including a second side wall member for defining a second lateral barrier plane opposable to said first lateral barrier plane;

attachment means for pivotably securing said second side wall member to said base member so that said second side wall member can pivot from an open position for loading and unloading to a closed position wherein said second lateral barrier plane is substantially opposed to said first lateral barrier plane;

spacing means, including a plurality of elongate spacer elements rigidly attached to one of said base member, said first side wall member and said second side wall member, for defining a minimum distance between said first side wall member and said second side wall member and for defining at least one window to enable attachment of objects to the outer surface of the balloon upon a disposition of the balloon in the device; and locking means for temporarily locking said second side wall member in said closed position.

20. The device defined in claim 19 wherein said spacer elements include a plurality of rods extending substantially parallel to said base plane and to each other, each of said rods being attached at one end to said first side wall member.

* * * * *